US007049556B2

(12) United States Patent
Aoki et al.

(10) Patent No.: US 7,049,556 B2
(45) Date of Patent: May 23, 2006

(54) HEATING DEVICE

(75) Inventors: Yukihiro Aoki, Okaya (JP); Kazuhiro Karatsu, Ina (JP)

(73) Assignee: Olympus Corporation, Tokyo (JP)

( * ) Notice: Subject to any disclaimer, the term of this patent is extended or adjusted under 35 U.S.C. 154(b) by 17 days.

(21) Appl. No.: 10/978,489

(22) Filed: Nov. 2, 2004

(65) Prior Publication Data

US 2005/0109768 A1 May 26, 2005

(30) Foreign Application Priority Data

Nov. 11, 2003 (JP) ..... 2003-381236

(51) Int. Cl.
*H05B 3/16* (2006.01)

(52) U.S. Cl. ..... 219/543; 219/544; 219/538; 219/542; 219/546; 219/549; 72/204.26; 72/204.17; 72/204.19; 72/204.11; 72/204.23

(58) Field of Classification Search ..... 219/543, 219/544, 538, 542, 546, 549; 73/204.26, 73/204.17, 204.19, 204.11, 204.23
See application file for complete search history.

(56) References Cited

U.S. PATENT DOCUMENTS

| | | | |
|---|---|---|---|
| 6,450,025 | B1 | 9/2002 | Wado et al. |
| 2003/0019860 | A1 | 1/2003 | Sol |
| 2003/0175527 | A1 | 9/2003 | Lingle |

FOREIGN PATENT DOCUMENTS

| | | | |
|---|---|---|---|
| EP | 0 859 536 | | 8/1998 |
| GB | 2327028 | | 1/1999 |
| JP | 11-31577 | | 2/1999 |
| JP | 2000-002571 | | 1/2000 |
| JP | 2000-2571 | * | 1/2000 |

* cited by examiner

*Primary Examiner*—Shawntina T. Fuqua
(74) *Attorney, Agent, or Firm*—Westerman, Hattori, Daniels & Adrian, LLP.

(57) ABSTRACT

A heating device at least having an electrically insulating film formed on a surface of a substrate, a heating member formed on the electrically insulating film, and a protection film formed over the electrically insulating film and the heating member, the electrically insulating film and the protection film containing a silicon nitride film having a silicon cont ent in excess of an elemental ratio of silicon to nitrogen of 3:4.

4 Claims, 4 Drawing Sheets

HEATING DEVICE

This application claims benefit of Japanese Patent Application No.2003-381236 filed in Japan on Nov. 11, 2003, the contents of which are incorporated by this reference.

BACKGROUND OF THE INVENTION

The present invention relates to heating device, and more particularly relates to a heating device of which an electrically insulating film and protection film for covering a heating member are improved.

Japanese Patent Application Laid-Open 2000-2571 discloses a hot-wire microheater as a heating device having a heating member and an electrically insulating thin film for protecting the heating member. A sectional view of the hot-wire microheater as disclosed in the publication is shown in FIG. 1. Referring to FIG. 1, a hot-wire microheater 101 includes: a substrate 102 made for example of silicon; an electrically insulating film 103 provided on the substrate 102; $Si_3N_4$ film 104 provided on the electrically insulating film 103; a heating member 105 provided on the $Si_3N_4$ film 104; and a protection film 106 laminated so as to cover the $Si_3N_4$ film 104 and heating member 105. Further, a hollow 107 is formed at a portion of the substrate 102 corresponding to the underneath of the heating member 105, so as to achieve a thermal insulation between the heating member 105 and the substrate 102.

The abovementioned publication also discloses a hot-wire microheater of another construction. A sectional view of the hot-wire microheater having such construction is shown in FIG. 2. Referring to FIG. 2, hot-wire microheater 101 includes: a substrate 102; an electrically insulating film 103 provided on a surface of the substrate 102; a heating member 105 made of a resistance member provided on the insulating film 103; a first protection film 108 for covering the heating member 105 and the insulating film 103; a reinforcing section 109 for covering a region of the first protection film 108 corresponding to the heating member 105; a second protection film 110 for covering the reinforcing section 109 and the first protection film 108; and a thermal insulating hollow 107 provided in the substrate 102 corresponding to the underneath of the heating member 105. It is then said that the first protection film 108 and second protection film 110 may be formed of $SiO_2$, $Si_3N_4$, alumina ($Al_2O_3$), or magnesia (MgO), or a composite of these. Further it is said that the reinforcing section 109 is formed of $Si_3N_4$.

A thin-film calorific heater having construction as shown in FIG. 3 is disclosed in Japanese Patent Application Laid-Open Hei-11-31577 as a heating device of another construction having a heating member and an electrically insulating thin film for protecting the heating member. As shown in FIG. 3, thin-film calorific heater 201 includes: a plurality of unit heating member 203 formed as a thin film coating of a certain pattern on a substrate 202; and a protection film 205 formed as applied on an upper surface of the unit heating members 203 and electrodes 204 thereof so as to provide protection therefor. It is said therein that the protection film 205 is formed of one selected from $Si_3N_4$, $SiO_2$, or SiC.

SUMMARY OF THE INVENTION

It is an object of the present invention to provide a heating device having a reliable heating section having high dielectric strength, high electrostatic resistance, and high heat resistance.

In a first aspect of the invention, there is provided a heating device at least having an electrically insulating film formed on a surface of a substrate, a heating member formed on the electrically insulating film, and a protection film formed over the electrically insulating film and the heating member. The electrically insulating film and the protection film contain a silicon nitride film having a silicon content in excess of an elemental ratio of silicon to nitrogen of 3:4.

In a second aspect of the invention, the electrically insulating film in the heating device according to the first aspect is laminated.

In a third aspect of the invention, the protection film in the heating device according to the first or second aspect is laminated.

DESCRIPTION OF THE PREFERRED EMBODIMENTS

Some embodiments of the invention will be described in the following.

Figure 1:
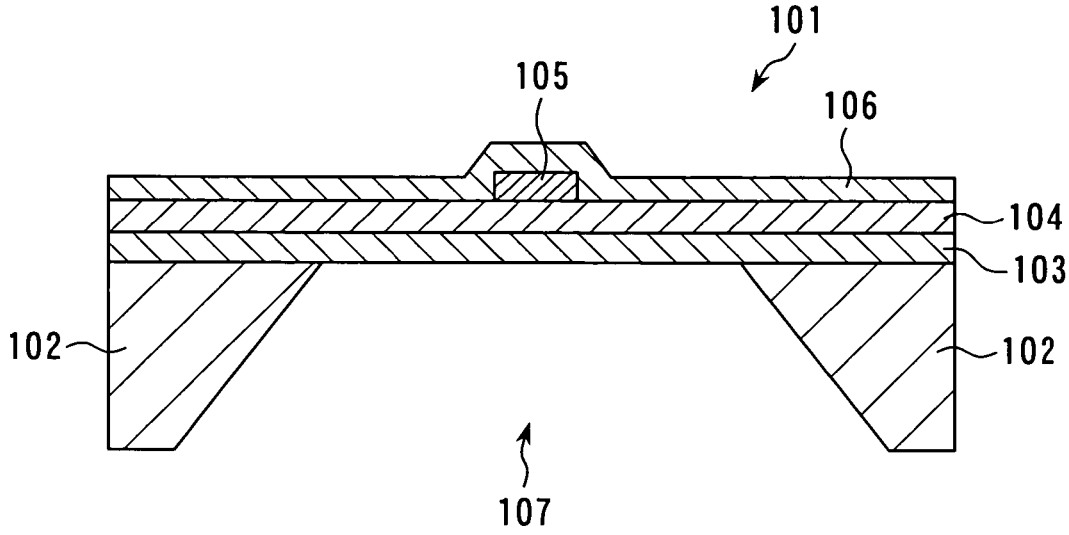
FIG. 1 PRIOR ART
FIG. 1 is a sectional view showing an example of construction of the conventional heating device.
Figure 2:
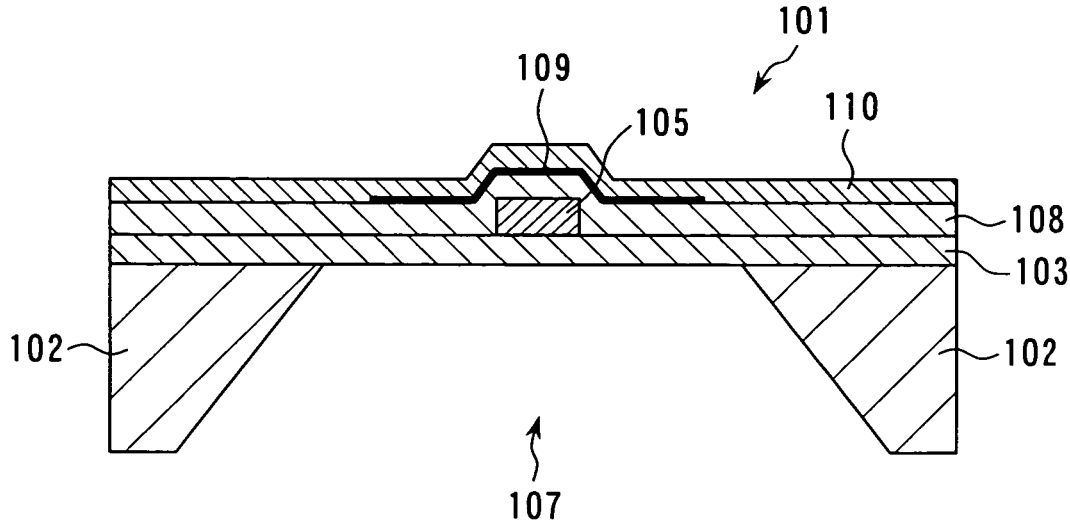
FIG. 2 PRIOR ART
FIG. 2 is a sectional view showing another example of construction of the conventional heating device.
Figure 3:
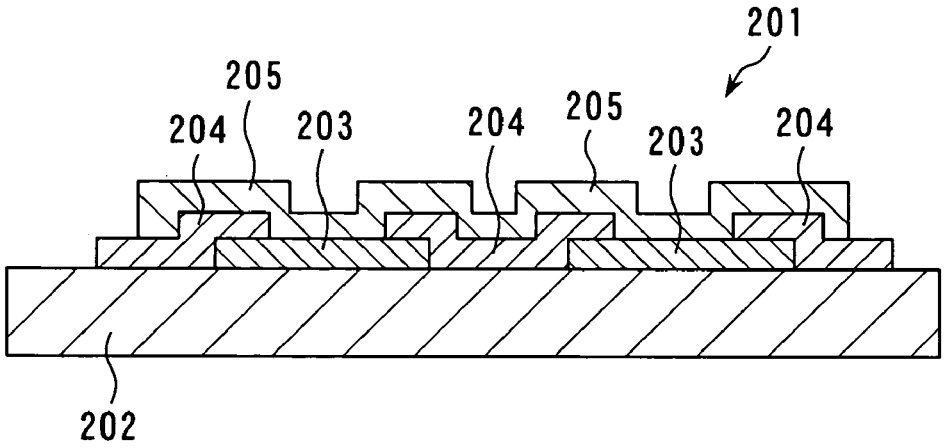
FIG. 3 PRIOR ART
FIG. 3 is a sectional view showing yet another example of construction of the conventional heating device.
Figure 4:
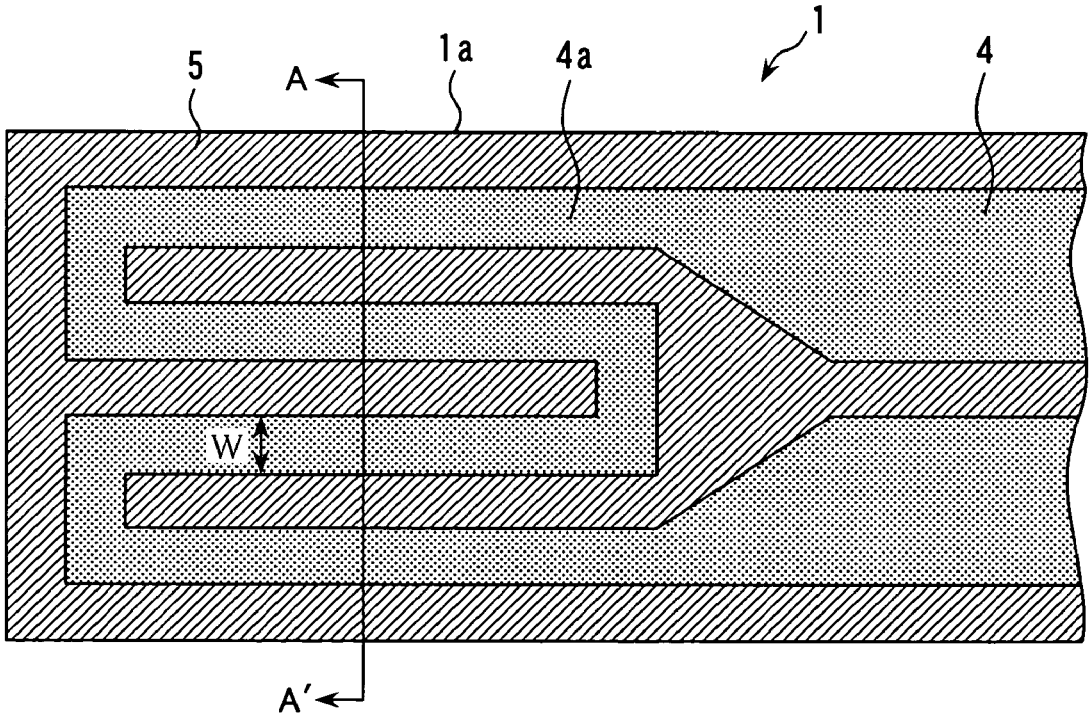
FIG. 4 is a top view showing the construction of a heating section of a first embodiment of the heating device according to the invention.
Figure 5:
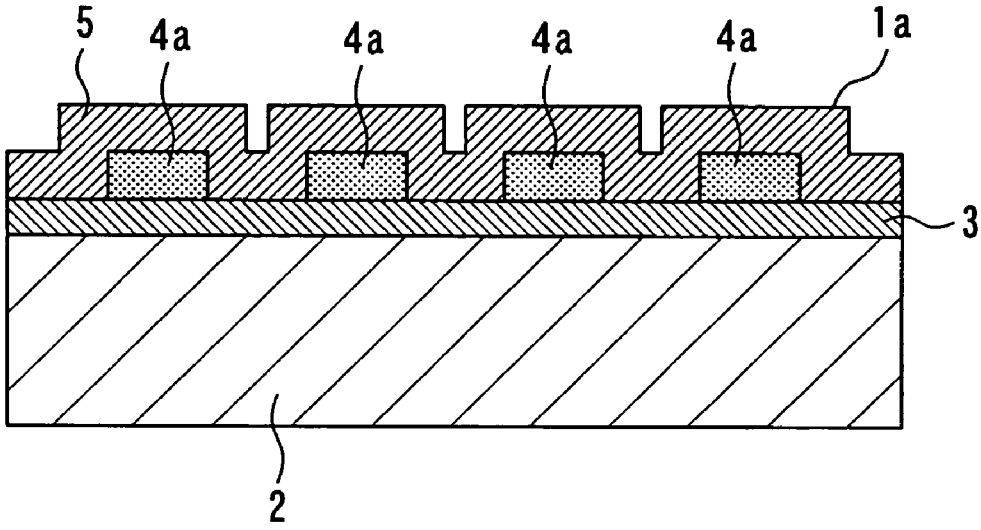
FIG. 5 is a sectional view along line A–A' in the heating device shown in FIG. 4.

A first embodiment will now be described. FIG. 4 is a top view showing the structure of a heating section 1*a* of heating device 1 according to the first embodiment with omitting a portion thereof. FIG. 5 is a sectional view along line A–A' in the heating section 1*a* of heating device 1 shown in FIG. 4. These figures include: 2, a silicon substrate; 3, an electrically insulating film made of silicon nitride formed on the silicon substrate 2; 4, a heating member made for example of a precious metal, or nickel-chromium, or silicon, or high melting point metal such as molybdenum or tungsten; and 5, a protection film for covering the heating member 4. Here, the electrically insulating film 3 and protection film 5 are formed of a silicon nitride film having a greater silicon content than silicon nitride film of the conventional composition. Numeral 4*a* denotes a grid-like slender portion of the heating member 4 in the heating section 1*a*.

A brief description will now be given with respect to fabrication method of the heating device 1 having such construction. First the electrically insulating film 3 having a thickness of 50 nm or more is formed on the silicon substrate 2. While a silicon substrate is used herein as the substrate 2, the material of the substrate is not limited to this and a metal, ceramic, glass or quartz may be used. Further the electrically insulating film 3 is a silicon nitride film having a greater silicon content than silicon nitride film ($Si_3N_4$) of the conventional composition where the elemental ratio of silicon to nitride is 3:4, and it is deposited by using Low Pressure Chemical Vapor Deposition (LP-CVD). In particular, this can be achieved by increasing the rate of dichlorosilane or monosilane in the flow ratio of dichlorosilane or monosilane to ammonia at the time of deposition to a level higher than that of the conventional composition.

Next, the heating member 4 is formed on the electrically insulating film 3 for example using a precious metal, or nickel-chromium, or silicon, or high melting point metal such as molybdenum or tungsten. At this time, width W of the heating member 4 is narrowed and at the same time its length is made longer in the region of the heating section 1*a* so as to form the heating member slender portion 4*a* into a grid-like configuration, thereby facilitating heat generation in the region of the heating section 1*a* of the heating device 1. The technique for forming the heating member 4 for example may be: the method of simultaneously effecting deposition and patterning of a precious metal or high melting point metal using a mask patterned into a desired configuration at the time of evaporation or sputtering onto the electrically insulating film 3; or the method of effecting photoetching after depositing a precious metal or high melting point metal all over the surface of the electrically insulating film 3.

Next, the protection film 5 is formed on the heating member 4. Here, the protection film 5 is a silicon nitride film having a grater silicon content than silicon nitride film ($Si_3N_4$) of the conventional composition, and it is deposited by using Low Pressure Chemical Vapor Deposition (LP-CVD). In particular, this can be achieved by increasing the rate of dichlorosilane or monosilane in the flow ratio of dichlorosilane or monosilane to ammonia at the time of deposition to a level higher than that of the conventional composition. As the above, the heating section 1*a* of the heating device 1 is completed.

By thus using a silicon nitride film having a greater silicon content as the electrically insulating film 3, internal stress thereof can be reduced and at the same time the film thickness of the electrically insulating film 3 can be increased as compared to silicon nitride film of the conventional composition. It is thereby possible to inhibit cracks on the insulating film 3 when the heating device is heated up and to obtain a high electrically insulating effect between the substrate 2 and the heating member 4 (4*a*). Also, since the silicon nitride film having greater silicon content has an oxygen cutting off effect similar to the conventionally composed silicon nitride film, it is able to cut off oxygen supply from the substrate 2 to the heating member 4 (4*a*) to prevent oxidation at the time of heating so that an improved heat resistance of the heating device can be achieved.

By using the silicon nitride film having greater silicon content also to the protection film 5, on the other hand, an internal stress thereof can be reduced as compared to the conventionally composed silicon nitride film. It is thus possible to inhibit cracks on the protection film 5 when the heating device is heated up, and to obtain a high electrically insulating effect between the outside of the heating device (atmosphere or a contact object touching the heating device) and the heating member. Further, since the silicon nitride film having greater silicon content has an oxygen cutting off effect similarly to the conventionally composed silicon nitride film, an improved heat resistance of the heating device can be achieved by the effect of cutting off oxygen from the outside of the heating device to the heating member.

Figure 6:
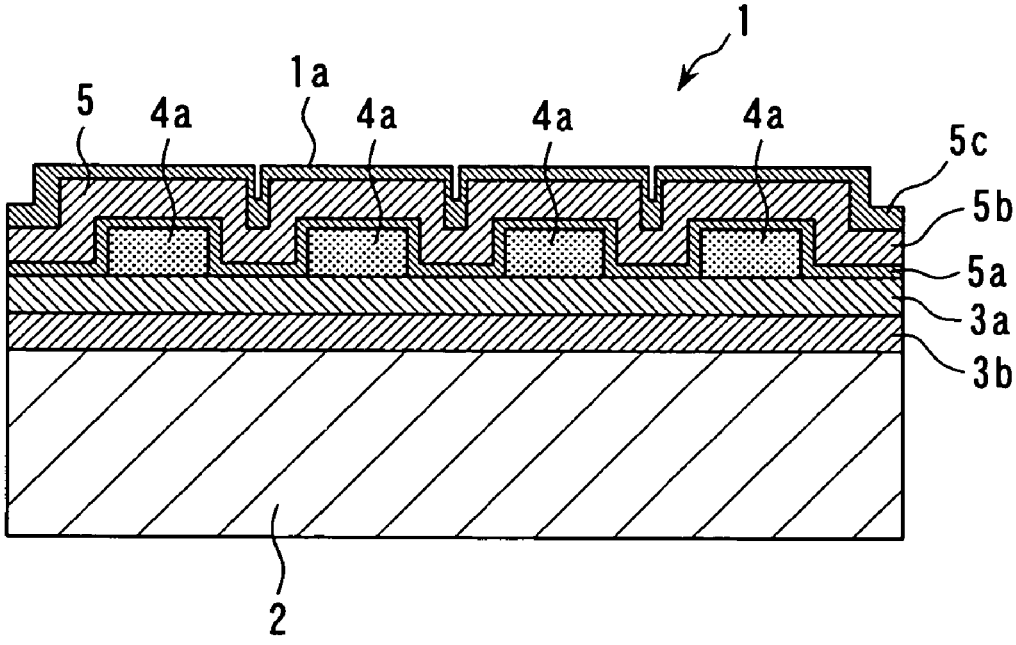
FIG. 6 is a sectional view showing the construction of a heating section of the heating device according to a second embodiment of the invention.

A second embodiment will now be described. FIG. 6 shows a sectional view of a heating section 1*a* of heating device 1 according to the second embodiment. FIG. 6 includes: 3*a* and 3*b*, two layers of electrically insulating films made of silicon nitride film formed on a substrate 2; 4*a*, a grid-like slender portion of heating member 4 made for example of a precious metal, or nickel-chromium, or silicon, or a high melting point metal such as molybdenum or tungsten; and 5*a*, 5*b* and 5*c*, three layers of protection films made of silicon nitride film for covering the heating member 4. Here, the 2-layer electrically insulating films 3*a* and 3*b* and the second layer protection film 5*b* are formed of a silicon nitride film having a greater silicon content than silicon nitride film of the conventional composition, and the first and third layer protection films 5*a* and 5*c* are formed of the conventionally composed silicon nitride film.

A brief description will now be given with respect to fabrication method of the heating device 1 according to the second embodiment having such construction. First the two layers of electrically insulating films 3*a* and 3*b* having a total thickness of 50 nm or more are formed on the substrate 2. Here the substrate 2 may be an electrically conductive material such as metal or silicon or an electrically insulating material such as ceramic, glass or quartz. The 2-layer electrically insulating films 3*a* and 3*b* are silicon nitride films having a greater silicon content than silicon nitride film ($Si_3N_4$) of the conventional composition, and are intermittently deposited into two layers by using Low Pressure Chemical Vapor Deposition (LP-CVD). In particular, this can be achieved by increasing the rate of dichlorosilane or monosilane in the flow ratio of dichlorosilane or monosilane to ammonia at the time of deposition to a level higher than that of the conventional composition.

Here the reason for forming the electrically insulating film into a laminate of electrically insulating films 3*a* and 3*b* is that, since the location of micropinhole is different between the electrically insulating films 3*a* and 3*b*, a debasement in electrically insulating effect between the substrate 2 and the heating member 4 (4*a*) due to micropinhole within the electrically insulating film can be avoided as compared to a single-layer electrically insulating film.

Next, the heating member 4 is formed on the electrically insulating film 3*b* for example using a precious metal, or nickel-chromium, or silicon, or a high melting point metal such as molybdenum or tungsten. At this time, a grid-like heating member slender portion 4*a* where width W of the heating member 4 is narrowed and its length is made longer is formed to facilitate heat generation at the region of the heating section 1*a* of the heating device 1. The heating member 4(4*a*) is formed in a similar manner as the first embodiment.

Next, the protection film 5*a* is formed as a first layer of protection film on the heating member 4(4*a*). Here the protection film 5*a* is formed by depositing silicon nitride film using low pressure Plasma Chemical Vapor Deposition (P-CVD). It is possible with the low pressure plasma chemical vapor deposition to deposit a silicon nitride film at low temperatures (of the order of 300° C.). By forming the protection film 5*a* at a low temperature, formation of oxide film on the surface of the heating member 4(4*a*) at the time of forming the first-layer protection film 5*a* can be suppressed even when the heating member 4(4*a*) is formed of a relatively easily oxidizable metal such as Ti, Mo, W, or nickel-chromium, or silicon. The first-layer protection film 5*a* may also be formed by using low pressure photo excited chemical vapor deposition, sputtering method or evaporation with which silicon nitride film can be formed at low temperatures similarly to the low pressure plasma chemical vapor deposition.

Next, the protection film 5*b* is formed as a second layer of protection film on the first-layer protection film 5*a*. The second-layer protection film 5*b* is a silicon nitride film having a greater silicon content than silicon nitride film ($Si_3N_4$) of the conventional composition, and it is deposited by using Low Pressure Chemical Vapor Deposition (LP-CVD). In particular, this can be achieved by increasing the rate of dichlorosilane or monosilane in the flow ratio of dichlorosilane or monosilane to ammonia at the time of deposition to a level higher than that of the conventional composition. Here, the first-layer protection film 5*a* has an effect of cutting off oxygen supply to the heating member 4(4*a*) when the second-layer protection film 5*b* is deposited, so as to suppress formation of oxide film on the heating member 4(4*a*). While the second-layer protection film 5*b* to be formed of the silicon nitride film having greater silicon content is of a single layer in this case, it may also be formed into a laminate.

Next, the third-layer protection film 5*c* is formed as the protection film of the uppermost layer on the second-layer protection film 5*b*. Here the third-layer protection film 5*c* is formed by depositing silicon nitride film at a low temperature (of the order of 300° C.) using low pressure Plasma Chemical Vapor Deposition (P-CVD). The third-layer protection film 5*c* may also be formed by using low pressure photo excited chemical vapor deposition, sputtering or evaporation with which silicon nitride film can be formed at low temperatures similarly to the low pressure plasma chemical vapor deposition.

Figure 7:
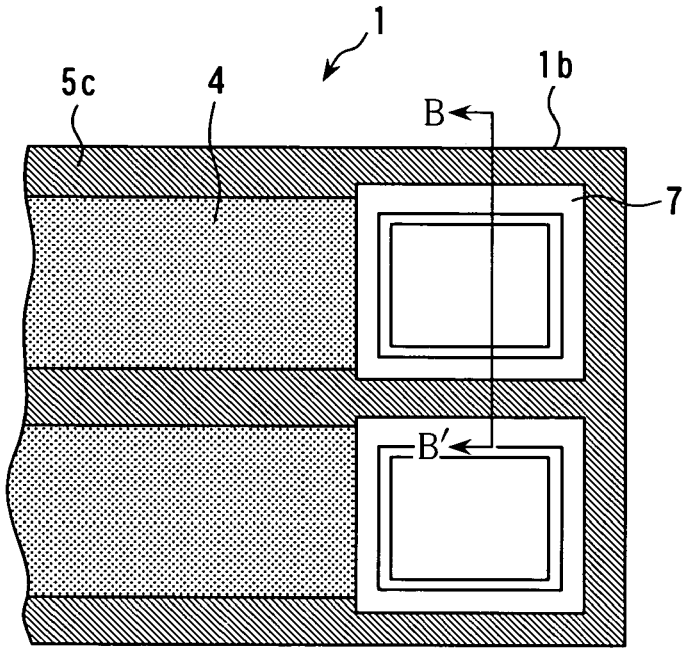
FIG. 7 is a top view showing the construction of an electrode section of the heating device according to the second embodiment of the invention.
Figure 8:
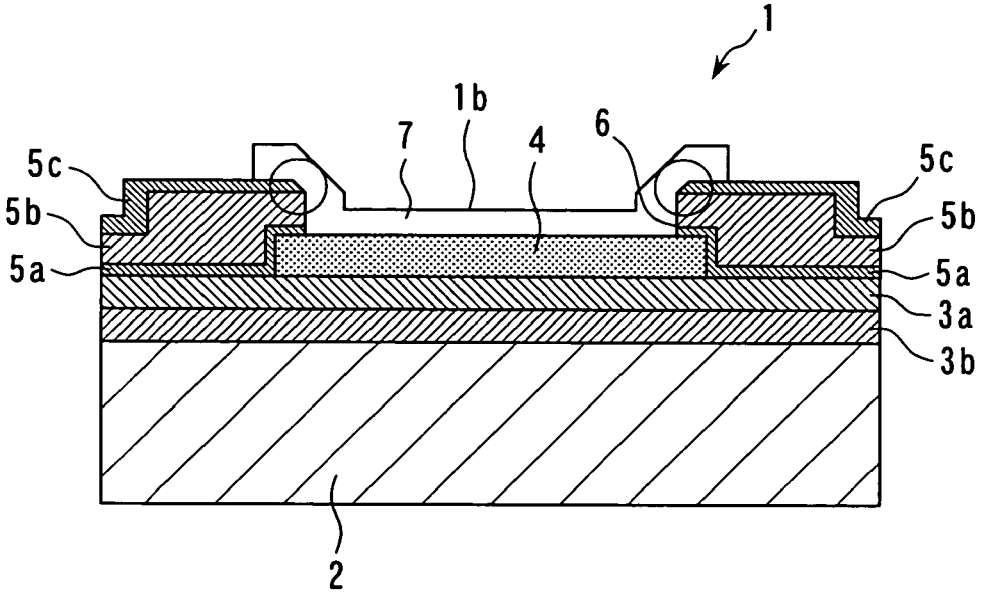
FIG. 8 is a sectional view along line B–B' in the electrode section of the heating device shown in FIG. 7.

While the forming of the heating section 1*a* of the heating device 1 is completed by the above processing steps, an electrode section 1*b* of the heating device 1 is subsequently formed. A top view of such electrode section 1*b* is shown in FIG. 7, and a sectional view along line B–B' in FIG. 7 is shown in FIG. 8. In these figures, numeral 6 denotes an opening obtained by removing the protection film 5 (5*a*, 5*b*, and 5*c*) over the heating member 4, and numeral 7 denotes an electrode film formed on the heating member 4 at the opening 6.

A brief description will now be given to the method of forming the electrode section 1*b*. First, in order to provide an electrode section at the heating member 4 on which the three layers of protection films 5*a*, 5*b*, 5*c* are formed, a resist for removing the protection films 5*a*, 5*b*, 5*c* on the heating member 4 is formed on the uppermost third-layer protection film 5*c*. Subsequently, the opening 6 extending from the third-layer protection layer 5*c* through the first-layer protection film 5*a* is formed by using Reactive Ion Etching (RIE). At this time, the etching rate through the uppermost third-layer protection film 5*c* formed at a low temperature is higher as compared to the second-layer protection film 5*b* in the middle which has been formed by LP-CVD method. For this reason, an etching region occurs also toward the sides of the uppermost third-layer protection film 5*c* as indicated by the mark of ○ in FIG. 5 within the time period during which the total film thickness from the surface of the third-layer protection film 5*c* through the first-layer protection film 5*a* is etched away. The edges of the opening 6 are thereby tapered. Subsequently, the resist is removed.

Next, an electrode film 7 consisting of an electrically conductive material is formed over a portion of the third-layer protection film 5*c* and within the opening 6 of the heating member 4. The electrode film 7 is formed using for example the method of simultaneously effecting deposition and patterning with using a mask of a desired configuration at the time of evaporation or sputtering, or the method of effecting photoetching after depositing the electrode film 7 all over the surface by evaporation or sputtering. Further, Al, Ni, or a combination of Cu/Cr, for example, may be used as the material of the electrode film 7.

Here, because of the tapered configuration at the edges of the opening 6 of the third-layer protection film 5*c*, a partial reduction in thickness of the electrode film 7 at the stepped portion of the edges of the opening 6 is prevented. A disconnection of the electrode film 7 at the edge's stepped portion of the opening 6 is thereby avoided to obtain an improved reliability.

The following advantages are obtained with the construction and fabrication method of the heating device according to the second embodiment as described. First, due to the laminated structure of the electrically insulating film in addition to the advantage of the first embodiment of using silicon nitride film having a greater silicon content as the electrically insulating film, a more higher electrically insulating effect between the substrate and the heating member can be obtained as compared to a single-layere electrically insulating film. A laminated structure consisting of the conventionally composed silicon nitride film and the silicon nitride film having higher silicon content may also be used as the laminated structure of the electrically insulating film to obtain similar advantage.

Further, by forming the protection film into a laminate, since the location of micropinhole in each protection film is different from one protection film to another, debasement in the electrically insulation effect between the outside of the heating device (atmosphere or a contact object touching the heating device) and the heating member due to the micropinhole in the protection film can be avoided.

Further, by forming the first-layer protection film 5*a* over the heating member 4 at a low temperature, oxidation of the heating member can be prevented even when it is formed of a material which is relatively easily oxidized. Accordingly, an oxidation of the heating member can be prevented even at the subsequent forming of the second-layer protection film 5*b* which is made of a silicon nitride film having greater silicon content. Further, since the electrically insulating films 3*a*, 3*b* have an oxygen cutting-off effect, an oxygen supply from the substrate 2 to the heating member 4 can be cut off to prevent an oxidation at the time of heating so that an improved heat resistance of the heating device can be achieved. Here, when a material such as platinum not likely to be oxidized is used as the heating member, the above described first-layer protection film 5*a* may be formed with using a silicon nitride film having greater silicon content.

Further, since silicon nitride film formed at a low temperature has a lower electrically insulating effect than silicon nitride film having greater silicon content, a high electrically insulating effect between the heating device and its outside can be obtained by using the silicon nitride film having greater silicon content for the second-layer protection film 5*b*. Furthermore, similarly to the first embodiment, it is possible with the electrically insulating film formed by using silicon nitride film having greater silicon content to reduce internal stress and at the same time to increase the film thickness of the electrically insulating film as compared to the conventionally composed silicon nitride film so that cracks on the electrically insulating film can be suppressed when the heating device is heated up. Since the silicon nitride film having greater silicon content has an oxygen cutting off effect similarly to the conventionally composed silicon nitride film, it is able to cut off an oxygen supply from the substrate to the heating member to prevent oxidation thereof at the time of heating so that an improved heat resistance of the heating device can be achieved. Moreover, when silicon nitride film having greater silicon content is used to form the first-layer protection film 5*a* and the uppermost third-layer protection film 5*c* of the protection film having three layers, the second-layer protection film 5*b* at the middle may be formed of a silicon nitride film of the conventional composition.

Furthermore, by forming the uppermost third-layer protection film 5*c* with using silicon nitride film by low pressure plasma chemical vapor deposition, a protection film etching region occurs also toward the sides when an opening for disposing an electrode film is formed. The edges of the opening are thereby formed into a tapered configuration so that disconnection at the electrode film of an electrode section to be formed later can be avoided to improve reliability thereof. By forming the first-layer protection film 5*a* using silicon nitride film by low pressure plasma chemical vapor deposition, it is possible to prevent oxidation of the heating member when the second-layer protection film 5*b* is subsequently formed by silicon nitride film having greater silicon content. Further, the electrically insulating films 3*a*, 3*b* are formed of silicon nitride film having greater silicon content and have an oxygen cutting off effect. For this reason, an oxygen supply from the substrate to the heating member can be cut off to prevent oxidation thereof at the time of heating so that an improved heat resistance of the heating device can be achieved. Here, if a step coverage characteristic not requiring a tapered configuration at the edges of the protection film etching region (opening) is provided in the forming of the electrode film, silicon nitride film having greater silicon content can be used for the uppermost third-layer protection film 5*c*.

While laminated structures of the electrically insulating film consisting of two layers and of the protection film consisting of three layers have been shown in the present embodiment, the laminated structures are not limited to these.

As the above, with the first aspect of the invention: an electrically insulating effect between the substrate and the heating member and that between an outside of the heating device and the heating member can be secured; crack on the electrically insulating film and protection film can be inhibited when the heating device is heated up; and at the same time it is possible to suppress oxidation of the heating member. It is thereby possible to achieve a heating device having high dielectric strength, high electrostatic resistance and high heat resistance. With the second aspect of the invention, it is possible to provide a heating device capable of further improving dielectric strength and electrostatic resistance between the substrate and the heating member. With the third aspect of the invention, it is possible to provide a heating device capable of further improving dielectric strength and electrostatic resistance between an outside of the heating device and the heating member.

What is claimed is:

1. A heating device comprising at least:

an electrically insulating film formed on a surface of a substrate;

a heating member formed on the electrically insulating film; and a protection film formed over said electrically insulating film and said heating member;

wherein said electrically insulating film and said protection film contain a silicon nitride film having a silicon content in excess of an elemental ratio of silicon to nitrogen of 3:4.

2. The heating device according to claim 1, wherein said electrically insulating film is laminated.

3. The heating device according to claim 1, wherein said protection film is laminated.

4. The heating device according to claim 2, wherein said protection film is laminated.

* * * * *